United States Patent [19]

Maisch

[11] Patent Number: 4,724,811

[45] Date of Patent: Feb. 16, 1988

[54] THROTTLE VALVE ADJUSTER

[75] Inventor: Wolfgang Maisch, Schwieberdingen, Fed. Rep. of Germany

[73] Assignee: Robert Bosch GmbH, Stuttgart, Fed. Rep. of Germany

[21] Appl. No.: 33,691

[22] Filed: Apr. 3, 1987

[30] Foreign Application Priority Data

Jun. 5, 1986 [DE] Fed. Rep. of Germany ..... 3618982

[51] Int. Cl.[4] ..... F02D 9/08

[52] U.S. Cl. ..... 123/361; 123/399

[58] Field of Search ..... 123/361, 399, 403; 180/178, 179

[56] References Cited

U.S. PATENT DOCUMENTS

| | | | |
|---|---|---|---|
| 4,385,675 | 5/1983 | Blee | 123/361 |
| 4,409,940 | 10/1983 | Gaus | 123/361 |
| 4,601,271 | 7/1986 | Ejiri et al. | 123/399 |

FOREIGN PATENT DOCUMENTS

| | | | |
|---|---|---|---|
| 2055874 | 5/1972 | Fed. Rep. of Germany | 123/361 |
| 2559209 | 8/1985 | France | 123/361 |
| 153945 | 9/1984 | Japan | 123/361 |

*Primary Examiner*—William A. Cuchlinski, Jr.
*Attorney, Agent, or Firm*—Edwin E. Greigg

[57] ABSTRACT

A throttle valve adjuster with which a quantity of air supplied to an internal combustion engine during idling, for instance, can be adjusted. The adjuster comprises a stator which is supported within a throttle valve pipe and which is rotated by actuation of a driving pedal. Supported inside the stator is an armature, which is firmly connected to the throttle valve. Located on the stator is a coil winding, which initiates a magnetic flux that acts upon the armature via two oppositely disposed guide shoulders which forms between the armature air gaps and the guide shoulders. The armature rotates relative to the stator counter to the force of a spring. The entire rotational movement of the throttle valve is thus a combination of the relative movement between the stator and the throttle valve pipe and the relative movement between the armature and the stator. If the driving pedal is not actuated, for instance as in engine idling, then the flow cross section uncovered in the throttle valve pipe by the throttle valve is a function of the rotational angle between the armature and stator and hence of the intensity of the current flowing through the coil winding.

8 Claims, 1 Drawing Figure

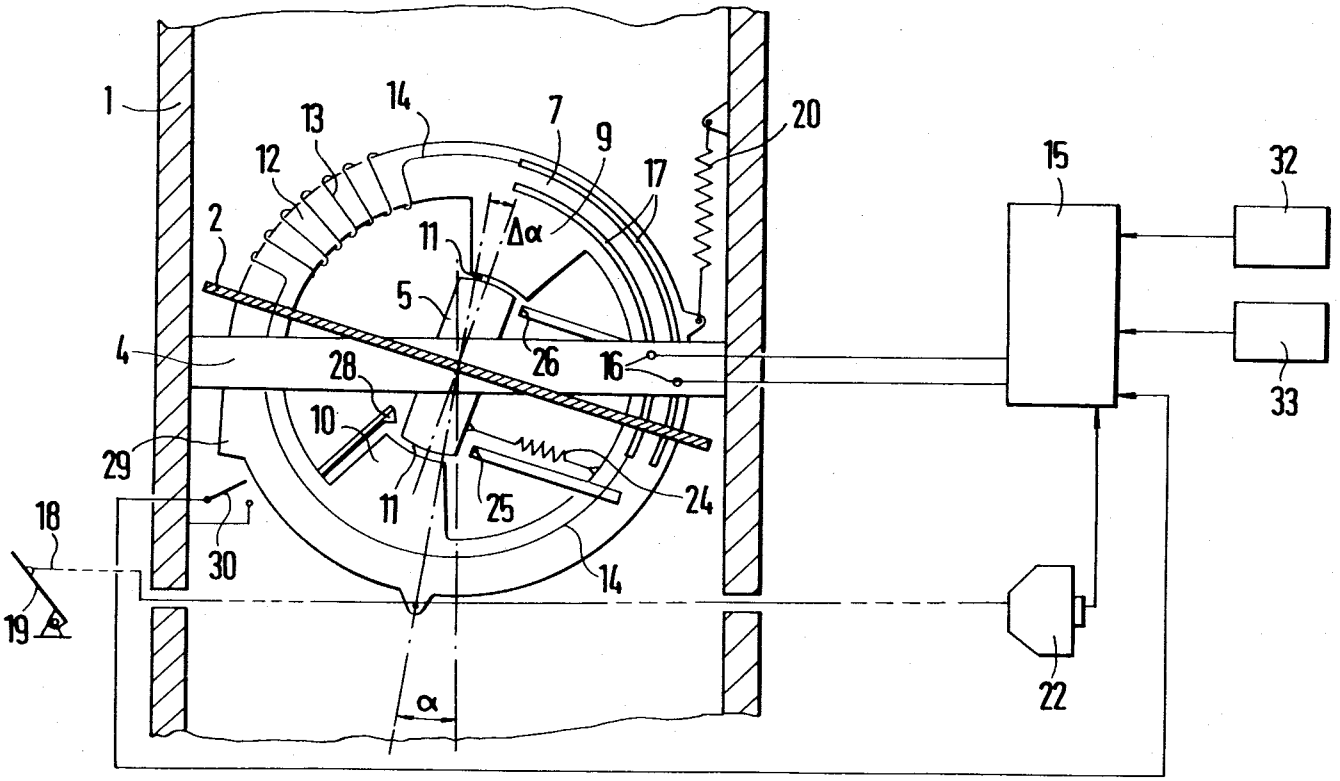
32
33
15
22
20
17
9
7
Δα
14
13
12
2
1
4
29
18
19
16
26
24
25
14
11
5
28
10
11
α
30

THROTTLE VALVE ADJUSTER

BACKGROUND OF THE INVENTION

The invention is based on an adjuster for a throttle valve such as usually used in internal combustion engines. Various kinds are already knwon; German Offenlegungsschrift No. 29 42 433, for example, shows an idling adjuster in which the idling position of the throttle valve is defined by means of a control motor mounted outside the intake tube. A similar arrangement is shown in German Offenlegungsschrift No. 29 40 545. The known constructions share the feature that the adjusting device defining the idling position of the throttle valve is connected to a stop with which the throttle valve is always in contact whenever the driving pedal of the engine is not actuated.

In principle, these idling adjusters have the disadvantage that the throttle valve position can be varied only in its idling position, but not when the throttle valve is partly or completely open.

Conventional systems most often use servo motors and electrical magnetic valves as the adjusting devices, although their large and relatively heavy structure increases the structural volume of an idling adjuster. These system also have a relatively long response time to electrical signals. European Patent No. 01 54 035 discloses a throttle valve adjuster the rotational angle of which is adjusted solely via a rotor mounted firmly on the throttle valve shaft. This kind of throttle valve actuation can be classified under the term "electronic gas pedal"; there is no mechanical transmission at all between the driving pedal that the driver actuates and the throttle valve. The disadvantage of this apparatus is that if the electronic control unit is defective, the throttle valve assumes its closing position, in response to a corresponding spring force; then emergency operation of a vehicle equipped in this way is no longer possible.

The apparatus described in European Patent No. 01 54 136 thus goes counter to the trend of designing electrically triggered systems in such a way that a position assuring emergency operation is automatically assumed in the event of some functional failure.

OBJECT AND SUMMARY OF THE INVENTION

The throttle valve adjuster according to the invention has the advantage over the prior art that its small, flat structure makes a small structural volume, which is well adapted to the shape of the throttle valve pipe, possible. The proposed embodiment, in which a rotary adjuster triggered by an electronic control unit generates the adjusting moment upon the throttle valve in a manner similar to a rotary coil instrument, is also distinguished by rapid response to electrical signals. This enables a precise and rapid adaptation of idling behavior when the adjuster is used in an internal combustion engine; the idling rpm of the engine can be reduced consideralby, which keeps fuel consumption low.

As compared with conventional systems, the adjuster according to the invention also has the advantage that pivoting movement can be realized even in the vicinity of the idling position of the throttle valve. Thus, it becomes possible to actuate only a portion of the 90° full-load position of the throttle valve mechanically via the throttle linkage, and to realize the remaining angular range via the pivoting movement of the adjuster. Since the kinematics of a 90° pivoting movement of the throttle valve are difficult to line-arize when known throttle linkages are used, such a decrease in the angular range transmitted by the throttle linkage goes far toward meeting the needs of those skilled in the art.

In contrast to the adjuster for a throttle valve shown in European Patent No. 01 54 036, engine operation is possible even if the electronic control unit should fail.

The invention will be better understood and further objects and advantages thereof will become more apparent from the ensuing detailed description of a preferred embodiment taken in conjunction with the drawing.

BRIEF DESCRIPTION OF THE DRAWING

The single drawing FIGURE is a simplified illustration of an exemplary embodiment of the throttle valve adjuster according to the invention.

DESCRIPTION OF THE PREFERRED EMBODIMENT

The throttle valve adjuster, shown by way of example in the drawing, is located inside a preferably cylindrical throttle valve pipe 1. Inside the throttle valve pipe 1 is the throttle valve 2, which by way of example is embodied as a circular disc. The bearing of the throttle valve 2 inside the throttle valve pipe 1 may be one-sided or two-sided, and it may be inside or outside the plane of the diameter of the throttle valve pipe 1. If the bearing is provided inside the diameter plane of the throttle valve pipe 1 there is the advantage that when there is a flow through the throttle valve pipe 1 only a slight resultant moment acts upon the throttle valve 2. On one end, the throttle valve 2 terminates in a hollow shaft, which in a manner not shown in the drawing is supported inside the throttle valve pipe 1 or inside a holder 4 that is firmly connected to the throttle valve pipe 1. In the direction opposite from the throttle valve 2, the aforementioned hollow shaft terminates in an armature 5. The armature 5 is aligned coaxially with the aforementioned hollow shaft and is coaxially surrounded by a stator 7. The stator 7 is guided inside the aforementioned hollow shaft by means of a shaft or journal, in a manner not shown, so that the armature 5 and stator 7 are capable of executing a rotational movement relative to one another. The basic shape of the stator 7 is that of a ring having for example a rectangular cross section. The stator 7 has two guide shoulders 9, 10 extending radially inward from directly opposite sides. The guide shoulders 9, 10 extend radially inward far enough that a gap 11 remains between them and an outer radius of the armature 5. The contours of the guide shoulder 9, 10 and armature 5 that form the gap 11 are in each case embodied such that adjoining surfaces extend spaced apart from one another by the same distance, so that the gap 11 has a constant cross section. This is preferably attained by providing that the contours of the guide shoulder 9, 10 and armature 5 that form the gap 11 are located on coaxial imaginary circles between the aforementioned hollow shaft and the inside jacket of the stator 7. However, it is not an absolute requirement for the function of the adjuster that the gap 11 have a constant cross section. A conical gap is also possible.

The lengths of the contours of the guide shoulder 9, 10 and armature 5 that form the gap 11 may be dimensioned such that in a predetermined position of the armature 5 inside the stator 7, these contours extend not merely spaced apart by the same distance from one another but also completely coincide with one another. In that case, the gap 11 attains its maximum extension. The more the armature 5 and stator 7 move rotationally relative to one another, beginning at this position, the shorter the gap 11 becomes. The length of the gap 11 is accordingly dependent on the relative angular position of the armature 5 and the stator 7.

The armature 5 may be shaped approximately rectangularly, with a likewise rectangular cross section, and the outer ends may be cut in such a way that the aforementioned contour, which can be imagined as located on a coaxial circle, is generated. The radially inwardly extending guide shoulders 9, 10 embodied on the stator 7 have the shape of a trapezoid, in the exemplary embodiment; the (wider) base of the trapezoid can be imagined as located on the inner jacket of the stator 7, and the (narrower) top of the trapezoid can be imagined as the aforementioned contour that between itself and the outer contour of the armature 5 forms the gap 11. The shape of the guide shoulders 9, 10 need not necessarily be trapezoidal; other shapes are also conceivable here. It is, however, indispensable that both the stator 7 and the guide shoulders 9, 10 be of magnetically conductive material.

Part of the annular stator 7 forms a coil core 12, which is surrounded by a coil winding 13. The coil winding 13 is connected via electrical connection lines 14 to an electronic control unit 15. Since for this purpose an electrical transmission function must be established between a rotating part (the stator 7) and a stationary part (the holder 4), there are wiper contacts 16 in the holder 4, which run on conductor tracks 17 that in turn are connected to both ends of the coil winding 13 and are fixedly let into the stator 7. The wiper contacts 16, in turn, are connected to the electronic control unit 15.

The stator 7 is moved counter to the force of a restoring spring 20 by means of a throttle linkage or throttle cable 18, for example by the actuation of a driving pedal 19. Also connected to the stator 7 or throttle cable 18 is a throttle valve potentiometer 22, which emits a switching signal at predetermined throttle valve positions (e.g., full load or idling).

A spring 24 engages the armature 5 at one end and the stator 7 at the other, and the force of the spring 24 is oriented such that a twisting moment is exerted upon the armature 5 and hence upon the throttle valve 2, which tends to move the throttle valve 2 into a position that closes the throttle valve pipe 1. The movement of the armature 5 inside the stator 7 in response to the force of the spring 24 is limited by a minimum stop 25. For limiting the contrary movement of the armature 5, that is, a movement counter to the force of the spring 24, a maximum stop 26 is provided, which like the minimum stop 25 is connected to the stator 7. Rotational movement of the armature 5 inside the stator 7 is thus possible only within the spatial limits set by the minimum stop 25 and maximum stop 26. A second, adjustable maximum stop 28 that limits the rotational movement of the armature 5 in the same direction as the maximum stop 26 may be provided on the stator 7. The adjustable maximum stop 28 may be embodied as a bimetallic strip and may limit the maximum deflection angle of the armature 5 relative to the stator 7 for example as a function of the temperature of the air flowing in the throttle valve pipe 1.

A cam 29 may be located on the outer edge of the stator 7, closing a contact 30 whenever the stator 7 is in an unloaded state, that is, whenever the driving pedal 19 is not actuated. Since the information on the position of the stator 7 is provided to the throttle valve potentiometer 22, it is also possible for the contact 30 to be built into the throttle valve potentiometer 22. In that alternative case, the cam on the stator 7 is dispensed with.

From the description thus far it is apparent that the adjuster according to the invention comprises three components:

(1) a part firmly connected to the internal combustion engine and comprising the throttle valve pipe 1 and the holder 4, which may itself also be part of the throttle valve pipe 1;

(2) a first moving part, which can execute a rotational movement relative to the throttle valve pipe 1 and is embodied by the stator 7, the guide shoulders 9, 10, the minimum stop 25, the maximum stop 26, and the adjustable maximum stop 28; and (3) a second moving part, which is movable relative to the first moving part and hence relative to the throttle valve pipe 1 and which comprises the throttle valve 2 and the armature 5.

For a more thorough explanation of the functioning of the adjuster according to the invention, the rotational angle between the stator 7 and the throttle valve pipe 1 will now be designated as $\alpha$, and the rotational angle between the armature 5 or throttle valve pipe 1 and the stator 7 will be designated as $\Delta\alpha$. For the sake of better comprehension, both angles are shown in the drawing.

In the normal driving condition in an internal combustion engine equipped with the adjuster according to the invention, for instance at partial load or full load, the coil winding 13 is not supplied with current by the electronic control unit; as a result, no magnetic flux is induced in the coil core 12 of the stator 7 surrounding the coil winding 13, and no magnetic force is exerted upon the armature 5 via the guide shoulders 9, 10; the armature 5, being acted upon solely by the force of the spring 24, rests on the minimum stop 25, and the rotational angle $\Delta\alpha$ between the armature 5 and stator 7 becomes zero. The positioning angle of the throttle valve 2 inside the throttle valve pipe 1 is identical to the angle $\alpha$ between the stator 7 and throttle valve pipe 1; thus the positioning angle of the throttle valve 2 is dependent only on the position of the driving pedal 19 or of the throttle cable 18. This kind of throttle valve control, solely via the throttle cable 18, is typical of the prior art.

Contrarily, in the idling state of an internal combustion engine equipped with the adjuster according to the invention, the driving pedal 19 is not actuated; the angle $\alpha$ between the stator 7 and the throttle valve pipe 1 thereby becomes zero. In that case, that is, in the idling position of the driving pedal 19, the coil winding 13 is supplied with electric current at a predetermined intensity by the electronic control unit 15. As a result, a magnetic flux is induced inside the coil core 12 of the stator 7 surrounded by the coil winding 13, and this flux flows through the guide shoulders 9 and 10 as well as through the gaps 11 and the armature 5. Similarly to the function in a rotating coil instrument, by the increase of the magnetic flux the armature 5 is deflected in such a manner that the length of the gaps 11 increases as well; a balance of forces always prevails between the force of the spring 24 and the force of the magnetic flux acting upon the armature 5. By means of the force of the magnetic flux, the armature 5 is separated from the minimum stop 25 and by rotation assumes a position inside the stator 7 in accordance with the intensity of the current in the coil winding 13. The electrical signal intensity supplied by the electronic control unit 15 to the coil winding 13 accordingly decides the magnitude of the rotational angle $\Delta\alpha$ between the armature 5 and stator 7. In the case of the idling position of the driving pedal 19 under consideration, the electric triggering of the coil winding 13 accordingly effects a slight pivoting of the throttle valve 2 and hence an opening of the opening cross section uncovered by the throttle valve 2 inside the throttle valve pipe 1. As a result, an air flow becomes possible inside the throttle valve pipe 1; the engine is supplied with a quantity of air that is sufficient to assure smooth engine operation. In this last operating case, the rotational angle $\alpha=0$, and accordingly the rotational angle $\Delta\alpha$ determines the entire rotational angle of the throttle valve 2 inside the throttle valve pipe 1.

The electric power supplied to the coil winding 13 by the electronic control unit 15 may be dependent on various factors. Thus the electronic control unit 15 is supplied with data on the engine rpm (32), temperature (33) and positioning angle of the throttle valve 2 (via the throttle valve potentiometer 22), for example.

Possible applications for the above-described adjuster are found in various fields of idling rpm control. For example, the adjuster can be used for compensation purposes, by enlarging the rotational angle $\Delta\alpha$, if the portion of the throttle valve pipe 1 swept by the throttle valve 2 should become soiled and the air gap accordingly narrowed, a condition that can be ascertained from the engine rpm (32).

Similarly, the changes in the idling rpm caused by load changes during idling (such as servo assemblies or a gear change in the case of an automatic transmission) can be compensated for by increasing the angle $\Delta\alpha$.

With the kind of adjuster function described above, the coil winding 13 is triggered, and hence a rotational angle $\Delta\alpha$ is generated, only when the contact 30 is closed, or in other words whenever the driving pedal 19 is in its idling position. It is equally posible, however, to design the electronic control unit 15 such that control of the rotational angle $\Delta\alpha$ is effected in a partial- or full-load position of the driving pedal 19 as well. This could for example be done in order to prevent the rotational angle $\alpha$ swept by the stator 7 from becoming too large. In that case, the rotational angle $\Delta\alpha$ induced by triggering the coil winding 13 is added to the rotational angle $\alpha$ of the stator 7, and so the positioning angle of the throttle valve 2 inside the throttle valve pipe 1 amounts to $\alpha+\Delta\alpha$.

The task of the maximum stop 26 is to limit the deflection movement of the armature 7 inside the stator to a maximum value in the event of a malfunction inside the electronic control unit 15, and in this way to prevent an excessively high idling rpm of the engine. The magnitude of this maximum value of the rotational angle $\Delta\alpha$ is set by adjusting the maximum stop 26.

The location of the minimum stop 25, contrarily, is dimensioned such that in the event of failure of the electronic control unit 15 or of some other component of the electrical triggering, the armature 5 and hence the throttle valve 2 assume a position such that operation of the engine is still just barely assured if the driving pedal is not actuated.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. An adjuster for a throttle valve which limits a quantity of air supplied to an internal combustion engine, comprising a driving pedal, a flat circular throttle valve rotatable about a shaft inside a throttle valve pipe, a stator positioned to one side of said throttle valve pipe, an armature (5) fixedly connected to said throttle valve (2) and supported inside said stator (7) for rotation with said throttle valve (2) relative to said stator, said stator being rotatably connected to said driving pedal (19), said armature (5) being rotatable relative to the stator (7) counter to the force of a spring (24) by means of an electromagnetic force induced in said stator (7) according to engine operating parameters.

2. An adjuster as defined by claim 1, in which said stator (7) surrounds the armature (5) in the form of a ring, said stator (7) includes a coil core (12) surrounded by a coil winding (13), in which an electromagnetic force is induced in said core (12) when an electric current flows through the coil winding (13).

3. An adjuster as defined by claim 2, in which the rotational range of the armature (5) inside the stator (7) is limited by stops (25, 26, 28) in opposite rotational directions.

4. An adjuster as defined by claim 3, in which the position of at least one of the stops (25, 26, 28) is adjustable as a function of the temperature of the air flowing inside the throttle valve pipe (1).

5. An adjuster as defined by claim 2, which includes means for inducing a coil winding (13) has electric current flow through said coil winding (13) when the driving pedal (19) is not actuated.

6. An adjuster as defined by claim 2, which includes an electronic control unit (15) which varies a current flowing through the coil winding (13) and the intensity of the current is set in said electric control unit (15) as a function of operating parameters of the engine.

7. An adjuster as defined by claim 1, in which the rotational range of the armature (5) inside the stator (7) is limited by stops (25, 26, 28) in opposite rotational directions.

8. An adjuster as defined by claim 7, in which the position of at least one of the stops (25, 26, 28) is adjustable as a function of the temperature of the air flowing inside the throttle valve pipe (1).

* * * * *